US005602397A

United States Patent [19]

Pitts et al.

[11] Patent Number: 5,602,397

[45] Date of Patent: Feb. 11, 1997

[54] OPTICAL IMAGING SYSTEM UTILIZING A CHARGE AMPLIFICATION DEVICE

[75] Inventors: William K. Pitts; Kevin M. Walsh, both of Louisville, Ky.; Keith Solberg, Bloomington, Ind.

[73] Assignee: University of Louisville Research Foundation, Inc., Louisville, Ky.

[21] Appl. No.: 551,556

[22] Filed: Nov. 1, 1995

[51] Int. Cl.[6] ..... H01J 47/02

[52] U.S. Cl. ..... 250/374; 250/385.1

[58] Field of Search ..... 250/385.1, 374

[56] References Cited

U.S. PATENT DOCUMENTS 4,376,892 3/1983 Charpak et al. .
5,032,729 7/1991 Charpak ..... 250/385.1

FOREIGN PATENT DOCUMENTS 5-121036 5/1993 Japan ..... 250/374

OTHER PUBLICATIONS

S. F. Biagi, et al., "The microdot gas avalanche chamber: an investigation of new geometries," *Nucl. Instr. and Meth.* A361 (1995) 72–76. No month.

A. Oed, "Position–sensitive detector with microstrip anode for electron multiplication with gases," *Nucl. Instr. and Meth.* A263 (1988) 351–359. No month.

G. Charpak, et al., "The use of multiwire proportional counters to select and localize charged particles,"*Nucl. Instr. and Meth.* 62 (1968) 262–268. No month.

M. Lemonnier, et al., "First experimental results on new microstrip three dimensional geometry," *Nucl. Instr. and Meth.* A349 (1994) 274–276. No month.

F. Angelini, et al., "The micro–gap chamber," *Nucl. Instr. and Meth.* A335 (1993) 69–77. No month.

F. Angelini, et al., "Further test and development of the micro–gap chamber," *Nucl. Instr. and Meth.* A349 (1994) 412–417. No month.

E. A. Babichhev, et al., "High pressure multiwire proportional and gas microstrip chambers for medical radiology," *Nucl. Instr. and Meth.* A360 (1995) 271–276. No month.

R. Ballazzini, et al., "Electric Field, Avalanche Growth and Signal Development in Micro–Strip Gas Chambers and Micro–Gap Chambers", *Rivista Del Nuovo Cimento,* vol. 17, N. 12, (1994) pp. 1–91. No month.

*Primary Examiner*—Constantine Hannaher
*Attorney, Agent, or Firm*—Woodard, Emhardt, Naughton, Moriarty & McNett

[57] ABSTRACT

An optical imaging system includes an array of optical imaging devices each comprising a device for providing charge amplification in a gaseous medium. A preferred embodiment of such a charge amplification device includes a substrate having a cavity defined therein, an anode surface positioned in the bottom of the cavity and a cathode positioned adjacent the cavity opening. A drift electrode is juxtaposed over the substrate opposite the cavity and defines a region containing a gaseous medium. As ionized charge pairs are established in the gaseous medium due to radiation provided by an external radiation source, electrons are attracted toward the anode where they undergo avalanche multiplication with the gaseous medium under the influence of an intense electric field established between the anode and cathode. As a result of the avalanche process, the gaseous medium within the avalanche region emits photons, predominately in the UV region, which are collected by the substrate and provided to a photon detector coupled thereto. The substrate is preferably provided with a wavelength shifting material operable to shift the UV light to the visible region, where it is thereafter imaged by the photon detector using, for example, conventional CCD camera technology.

26 Claims, 5 Drawing Sheets

OPTICAL IMAGING SYSTEM UTILIZING A CHARGE AMPLIFICATION DEVICE

This invention was made with government support under the National Science Foundation grants PHY 93-14783 and OSR 94-50547. The government has certain rights in the invention.

FIELD OF THE INVENTION

The present invention relates generally to imaging systems, and more specifically to such imaging systems including radiation detectors utilizing a charge amplification device based on charge multiplication processes in gaseous media to provide amplified radiation to a suitable detector.

BACKGROUND OF THE INVENTION

Numerous imaging systems for providing an image of a radiation field are known and widely used in a variety of disciplines. Early such images were usually provided in the form of X-ray film or paper. More recently, such images have been processed into digital images with acceptable resolution and have also been provided in the form of real-time images. However, such systems typically comprise very complex and expensive imaging and readout systems.

What is therefore needed is an inexpensive and easily constructed imaging system having a radiation detection and readout system. Such a system should be relatively simple to operate and replace, while at the same time preserve many of the attractive features, such as digitized data and advanced image processing techniques, of more complex systems.

SUMMARY OF THE INVENTION

The foregoing shortcomings of the prior art are addressed by the present invention. In accordance with one aspect of the invention, an imaging device for providing a radiative representation of charges comprises a substrate having a top surface and an opposite bottom surface, wherein the top surface defines a cavity having a cavity sidewall extending into the substrate, a gaseous medium disposed within the cavity, wherein the gaseous medium includes charges resulting from ionization thereof, and means for establishing avalanche ionization of the charges with the gaseous medium within the cavity to thereby provide amplified emission of photons from the gaseous medium. The cavity sidewall is operable to absorb emitted photons incident thereupon, and the substrate is operable to direct a portion of the absorbed photons to the bottom surface of the substrate.

In accordance with another aspect of the present invention, an imaging device for providing a radiative representation of charges comprises a dielectric substrate having a bottom surface and an opposite top surface defining a cavity therein, wherein the cavity has a cavity sidewall extending into the substrate and terminates in an electrically conductive anode surface, an electrically conductive cathode formed on the dielectric substrate top surface adjacent the cavity opening, wherein the cathode is operable to direct photons impinging thereupon from the dielectric substrate back into the dielectric substrate, and a gaseous medium in contact with the cathode and extending into the cavity into contact with the anode surface, wherein the gaseous medium includes charges resulting from ionization thereof. The anode surface and the cathode define a first electric field therebetween sufficient to cause avalanche ionization of the charges with the gaseous medium adjacent the anode surface to thereby provide amplified emission of photons from the gaseous medium. The cavity sidewall is operable to absorb emitted photons incident thereupon, and the substrate is operable to direct a portion of the absorbed photons to the bottom surface of the substrate.

One object of the present invention is to provide an optical imaging device operable to establish avalanche ionization with a cavity of a dielectric substrate, wherein the dielectric substrate is operable to absorb photons emitted during the avalanche ionization and direct a portion of the absorbed photons to an optical detector coupled to the substrate.

Another object of the present invention is to include a wavelength shifting material into or adjacent to the substrate. The purpose of this material is to convert the copious ultraviolet light into visible light suitable for imaging with, for example, CCD cameras.

Yet another object of the present invention is to provide such an optical imaging device wherein the dielectric substrate is configured to facilitate transmission of the absorbed photons toward the optical detector. An optically transparent coating, with index of refraction lower than the substrate, may be applied to the surface of the substrate, thus improving the efficiency of light transmission into the substrate and then into the optical imaging device.

A further object of the present invention is to provide an optical imaging system comprising a matrix of such optical imaging devices.

These and other objects of the present invention will become more apparent from the following description of the preferred embodiment.

DESCRIPTION OF THE PREFERRED EMBODIMENT

Figure 1:
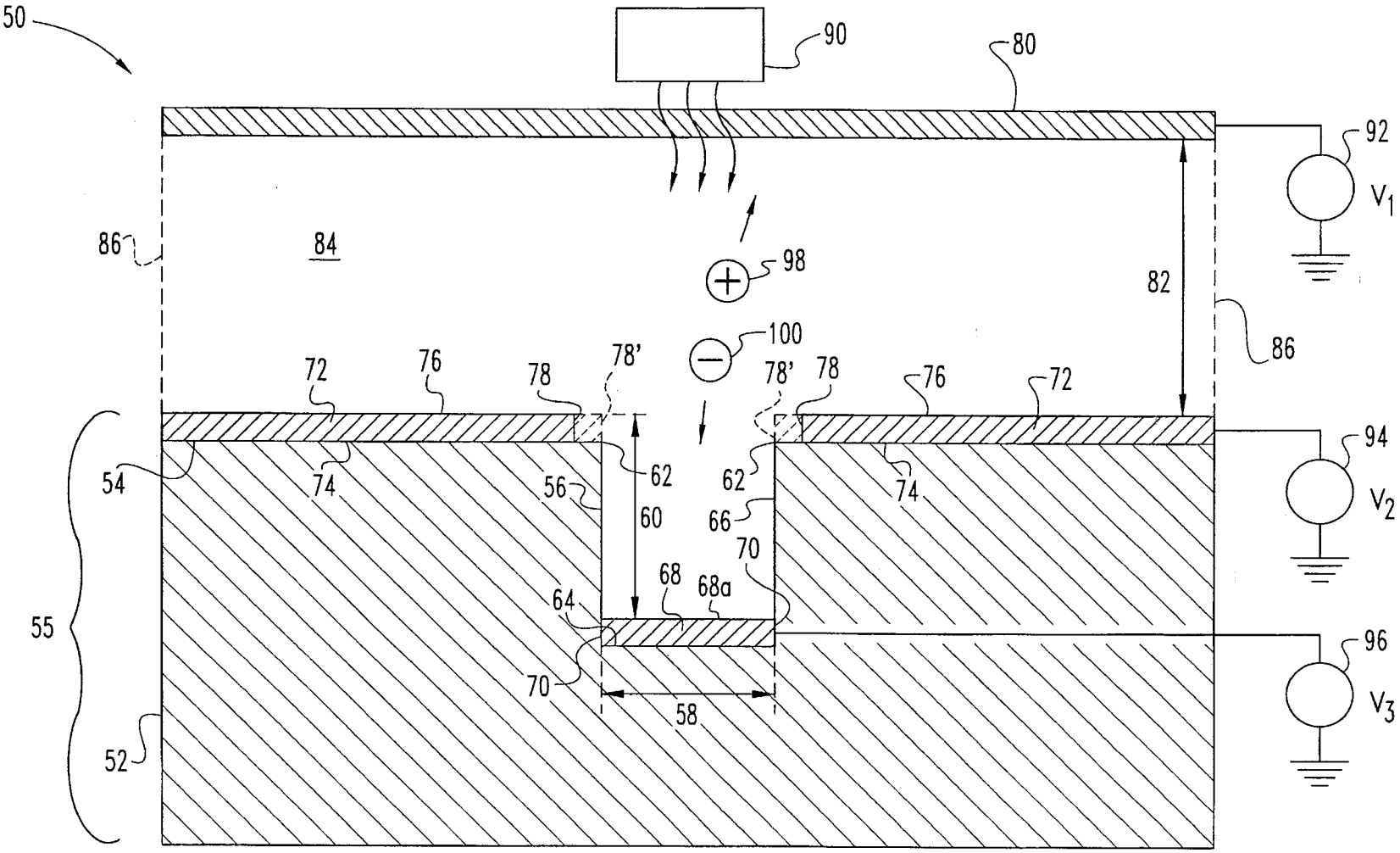
FIG. 1 is cross-sectional illustration of a device for providing charge amplification in a gaseous medium in accordance with he present invention.

For the purposes of promoting an understanding of the principles of the invention, reference will now be made to the embodiment illustrated in the drawings and specific language will be used to describe the same. It will nevertheless be understood that no limitation of the scope of the invention is thereby intended, such alterations and further modifications in the illustrated device, and such further applications of the principles of the invention as illustrated therein being contemplated as would normally occur to one skilled in the art to which the invention relates.

Referring to FIG. 1, a radiation detector 50 for providing charge amplification in a gaseous medium, which is particularly well suited for the optical imaging device of the present invention, is shown. A detailed explanation of radiation detector 50 is given in related U.S. patent application Ser. No. 08/551,472, entitled RADIATION DETECTOR BASED ON CHARGE AMPLIFICATION IN A GASEOUS MEDIUM, filed by Keith Solberg et al., and assigned to the assignee of the present invention, the contents of which are incorporated herein by reference.

Central to detector 50 is an electrode structure 55 which is preferably fabricated in accordance with known semiconductor processing techniques, although the present invention contemplates constructing electrode structure 55 in accordance with other techniques as will be discussed hereinafter. Electrode structure 55 includes a dielectric substrate 52 which may be formed of any known electrically insulating material and which is preferably conducive to semiconductor fabrication processes. Preferably, substrate 52 is formed of any of the commonly used semiconductor insulating materials such as, for example, silicon dioxide ($SiO_2$), silicon nitride ($Si_3N_4$), polyimide, quartz, other known glasses, polyester, and the like.

Substrate 52 includes a top surface 54 into which a cavity 56 is formed. Cavity 56 has an opening 62 which extends downwardly into the substrate 52 and terminates at a cavity bottom 64. Preferably, cavity 56 includes a substantially vertical cavity sidewall 66, although the present invention contemplates that cavity sidewall 66 may be made non-vertical in order to optimize the geometry of the avalanche region for a particular application as will be more fully discussed hereinafter. Cavity 56 may be formed by a variety of known semiconductor processing techniques such as by sawing or by laser cutting, for example, although cavity 56 is preferably formed by a known micro-machining process such as reactive etching. Cavity 56 may be provided with any desired width 58 that permits formation of the desired avalanche region geometry. In one embodiment the width 58 is in the range of a few micrometers. Similarly, cavity 56 may be provided with any desired depth 60 that permits formation of the desired avalanche region geometry. In one embodiment the depth 60 is between approximately 5–25 micrometers. Furthermore, cavity 56 may be provided in any of a variety of geometrical shapes. For example, in accordance with one embodiment of the present invention, cavity 56 is an elongated "trench," that is, a long narrow cavity 56. In an alternate embodiment, cavity 56 is a round "pit," that is, a round hole of some known diameter. It is to be understood, however, that cavity 56 may be any geometrical shape, having either rounded or unrounded corners, the importance of cavity 56 being that it has some depth with an anode disposed in the bottom thereof, a cathode adjacent its opening and a dielectric sidewall therebetween.

In the bottom 64 of cavity 56, an electrically conductive anode 68 is formed. Anode 68 has anode sidewalls 70 and an anode top surface 68*a*. Anode 68 is preferably formed such that anode sidewalls 70 abut cavity sidewalls 66 so that only the top surface 68*a* of anode 68 is exposed to the interior of cavity 56. However, the present invention contemplates that anode sidewall 70 may stop short of, or extend into, cavity wall 66. Preferably, anode 68 is formed of a metal having high electrical conductivity and having good adherence to the underlying substrate 52. A variety of such metals and metal composites are known and successfully implemented in the semiconductor industry, and in one embodiment, anode 68 is formed of tungsten or a titanium-tungsten alloy. Alternatively, anode 68 may be formed of a conductive sheet disposed in the bottom of the cavity 56. The conductive sheet may be, for example, Indium Tin Oxide, which can be 90% transparent to light. The photons in the avalanche region can then proceed through the anode to a light detection system as will be described in greater detail hereinafter. It should further be pointed out that a light transparent conductor (such as Indium Tin Oxide) may be used to form any of the anode 68 (or cathode 72) structures described herein. Finally, anode 68 may be formed of a wire inserted into a capillary tube with the top of the capillary tube coated with a conductor at the end of the wire acting as the anode.

An electrically conductive cathode 72 is formed along the top surface 54 of substrate 52 in the area adjacent cavity 56. Cathode 72 has a cathode bottom surface 74 that forms an interface with the top surface 54 of substrate, an opposite top surface 76 and a thickness therebetween. Cathode 72 terminates in a cathode sidewall 78 which preferably terminates short of the cavity opening 62. In one embodiment, cathode sidewall 78 terminates approximately 1–2 micrometers short of cavity opening 62. However, the present invention contemplates that cathode sidewall 78 may terminate at greater distances from cavity opening 62, or may be extended toward cavity opening 62, and may ultimately be arranged to form cathode sidewall 78', which is coterminous with cavity sidewall 66. As with anode 68, cathode 72 is formed of a metal having high electrical conductivity and having good adherence to the underlying substrate 52, such as, for example, tungsten or a titanium-tungsten alloy.

At a distance 82 above electrode structure 55, preferably a few millimeters, a drift electrode 80 is provided. Between drift electrode 80 and electrode structure 55, a gaseous medium 84 is provided. Gaseous medium may be any number of gases capable of avalanche ionization, although preferably gaseous medium 84 comprises a noble gas with little or no quench gas added thereto. It will be recognized by those skilled in the art, however, that many different gases and gas combinations may be used as gaseous medium 84, depending upon the particular application requirements. In any event, the gaseous medium region; i.e. that defined by the area between drift electrode 80 and electrode structure 55, is preferably hermetically sealed by sidewalls 86 to provide an enclosed gas chamber. Various gases at various pressures may then be used as the gaseous medium 84.

Although not shown in the drawings, drift electrode 80 may further be provided with a radiation transmissive window to permit a radiation source 90 to irradiate the gaseous medium 84 from above the drift electrode 80. However, drift electrode is preferably constructed of a radiation transmissive material t hat is further electrically conductive, such as, for example, a metallic grid structure. Radiation source 90 may be any known source capable of ionizing gaseous medium 84 to thereby create charge pairs (ie. positive charges and electrons). Examples such sources include alpha-particle sources, gamma-ray sources, X-ray sources, photon sources, neutron sources, and charged particle sources to name a few.

Detector 50 further includes means to create at least two ion accelerating fields: one between anode 68 and drift electrode 80, and one between anode 68 and cathode 72. Although the present invention contemplates utilizing any known means for establishing such ion accelerating fields, the present invention preferably uses a voltage source $V_1$ 92 connected to drift electrode 80, voltage source $V_2$ 94, connected to cathode 72 and voltage source $V_3$ 96 connected to anode 68. The foregoing voltage sources are used to establish a first electric field between anode 68 and drift electrode 80, and a second electric field between anode 68 and cathode 72.

The operation of detector 50 for providing charge amplification in a gaseous medium will now be described in detail.

Radiation source 90 is operable to create charge pairs 98 and 100 within the gaseous medium 84 as previously described. The electric field established between anode 68 and drift electrode 80 via voltage sources $V_3$ 96 and $V_1$ 92 respectively, causes pairs 98 and 100 to separate and drift toward an appropriate electrode. Preferably, the electric field established between anode 68 and drift electrode 80 is oriented such that positive charge 98 drifts toward drift electrode 80 and electron 100 drifts toward anode 68. However, the present invention contemplates that the electric field established between anode 68 and drift electrode 80 may be oppositely oriented such that positive ion 98 drifts toward anode 68.

A second, and much more intense, electric field is established between anode 68 and and cathode 72 via voltage sources $V_3$ 96 and $V_2$ 94 respectively. The purpose of this second electric field is to accelerate charges drifting toward anode 68 into avalanche ionization within the gaseous medium 84, to thereby provide a charge multiplication, or amplification, of which the positive charge is collected by cathode 72 and the negative charge is collected by anode 68. If the charges drifting toward anode 68 are electrons, then this second electric field is oriented to accelerate such electrons toward anode 68. If, however, the second electric field is reversed,, then element 68 becomes the cathode and the second electric field is operable to accelerate the positive charges toward the cathode 68.

An important advantage of the anode/cathode geometrical relationship, shown in FIG. 1 and forming a part of the present invention, over prior art anode/cathode arrangements is reduced susceptibility to a phenomenon known as photon feedback, which is related to certain physical properties of the types of gases used in radiation detectors. It is generally known that avalanche multiplication can occur in all gases. However, the choice of a particular gas, or gases, for use in a radiation detector of the type shown and described with reference to FIG. 1 is typically driven by various desirable and/or necessary operational parameters such as, for example, low working voltage, high gain operation, good proportionality, high rate capability, long lifetime and fast recovery to name a few. It is also generally known that avalanche multiplication occurs in noble gases at much lower electric fields than in complex molecules. However, during the avalanche process in a noble gas, excited and ionized atoms are formed which can only return to the ground state through a radiative emission. Thus, inherent in the avalanche ionization of a noble gas is the emission of radiation, predominately in the ultraviolet (UV) spectrum, but generally understood to be a mix of UV and visible light. As used hereinafter, the term "photon" refers to emission at any of abroad spectrum of wavelengths understood by those skilled in the art to comprise a radiative event. Examples of such photons include emission in the infrared (IR), visible and ultraviolet (UV) spectrums.

A large fraction of the emitted light is due to the radiative decay of the first excited state of the noble gas and, as such, has an energy above the work function of any metal that might comprise the cathode of a radiation detector. Such photons impinging upon the cathode therefore tend to extract photo-electrons therefrom which then initiate a secondary avalanche condition in the presence of the established electric field. Noble ions thus migrate to the cathode where they neutralize by extracting an electron from the cathode. The balance of energy left after extracting the electron is either radiated as a photon, or by secondary emission, i.e. extraction of another electron from the surface of the metal cathode. Photons emitted during electron-ion recombination, as well as photons emitted by the excited atoms, have sufficient energy to eject photo-electrons from the materials of the detector. These photo-electrons tend to propagate the discharge and produce spurious charge counts. To reduce this so called photon feedback effect associated with the use of noble gases, a "quench gas" is typically mixed with the noble gas, which acts to absorb charge from the ionized noble gas. The quench gas is typically a hydrocarbon gas such as isobutane, although various other gases, such as $CO_2$ or halogens, may also serve as quench gases. The use of such quench gases, however, tends to lead to deposition of undesirable residue on the electrode surfaces. Furthermore, some quench gases, such as the halogens, are highly reactive. Clearly, operation of such radiation detectors without the need for a quench gas would thus be highly desirable.

Owing to the structure of device 55, the photon feedback phenomenon is greatly reduced in the operation thereof. As seen with reference to FIG. 1, and more fully discussed with reference to FIG. 2, photons emitted from the avalanche region within cavity 56 will predominately be transmitted through the cavity sidewall 66 of dielectric substrate 52 to the bottom side 74 of Cathode 72. The structure of cavity 56, and positioning of the anode 68 and cathode 72, insures that only a small percentage of such photons will reach the cathode outer surface (primarily cathode sidewall 78). Thus, the majority of photo-electrons emitted from cathode 72 (i.e. those emitted from bottom surface 74) are inhibited from drifting to cavity 56 due to the low mobility of charges within dielectric substrate 52, so that most of such photo-electrons never reach the avalanche region proximate to anode surface 68*a*. In fact, only a very small percentage of such photo-electrons, namely those emitted from sidewall 78, have a chance of reaching the avalanche region. Photo-electric emissions from the drift electrode 80 is also suppressed in this geometry, since photons from the avalanche region have a direct line of sight to only that section of the drift electrode 80 located directly above the cavity 56. Thus, photon feedback in device 55 is greatly reduced, if not eliminated altogether. Such a reduction in photon feedback permits a corresponding reduction in, or possible elimination of, the fraction of quench gas required in the gaseous medium 84. Thus, system 50 may be sealed and filled only with a noble gas. Heretofore; the operation of such a charge amplification system with strictly a noble gas medium has been achieved, but at greatly reduced gain, particularly when using the lighter noble gases.

As a result of the above-described anode/cathode structure, namely that of positioning the anode 68 within a dielectric cavity 56 and positioning the cathode 72 adjacent the cavity opening 62, not only may radiation be detected at the cathode 72 of such a device 50 as previously described, but certain structural enhancements can be made to optimize detection of the photons transmitted through the cavity sidewall 66 of dielectric substrate 52. By optimizing the structure of radiation detector 50, and providing suitable means for detecting photons from within substrate 52, an imaging system, based on charge multiplication processes in gaseous media, can be provided.

Figure 2:
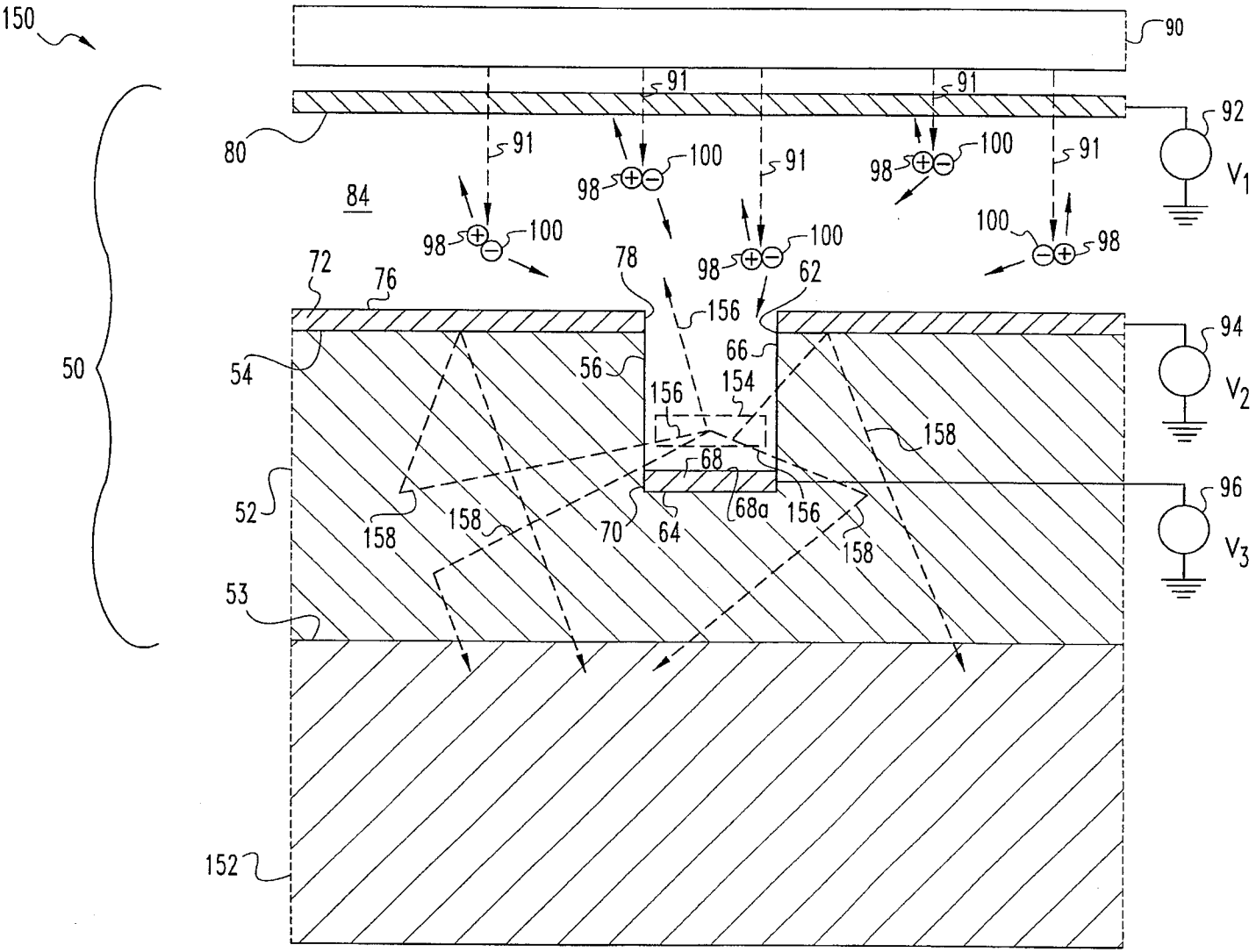
FIG. 2 is a cross-sectional illustration of an optical imaging device, in accordance with the present invention, utilizing the charge amplification device of FIG. 1.

Referring now to FIG. 2, such an optical imaging device 150, in accordance with the present invention, is shown. Device 150 preferably incorporates the radiation detector 50 of FIG. 1, and like numbers are therefore used to illustrate like components. As previously described, radiation source 90 is preferably an X-ray source, although the present invention contemplates using other known radiations sources 90 as well, and drift electrode 80 is preferably formed of a material that is transparent to radiation emitted from radiation source 90 such as, for example, a metallic grid. Source 90 is operable to emit radiation through drift electrode 80 and form charge pairs 98/100 within gaseous medium 84. Preferably, an electric field is established between anode 68 and drift electrode 80 so that positive charges 98 drift toward drift electrode 80, and electrons 100 drift toward anode 68 under the influence of the electric field However, as with detector 50, the present invention contemplates uses of system 150 wherein the electric field may be reversed so that electrons 100 drift toward drift electrode 80, and positive charges 98 drift toward anode 68.

As electrons 100 reach avalanche region 154, located adjacent anode surface 68*a* as previously discussed, photons 156 are emitted from gaseous medium 84 in various directions as shown. A small portion of the photons 156 are directed out of cavity 56. A greater portion of the photons 156 are directed toward the sidewall 66 of cavity 56. In the general case, such photons 156 will primarily be captured by the dielectric substrate 52 when photons incident thereupon are within a few degrees of a direction normal to sidewall 66. Photons 156 emitted at more extreme angles to the normal of sidewall 66 tend to be reflected, rather than trapped, by the sidewall 66 due to the differing indices of refraction between sidewall 66 and gaseous medium 84.

In cases where avalanche ionization results in emission of photons 156 within the UV spectrum (which is typically the case when using a noble gas as the gaseous medium 84), dielectric substrate 52 is preferably formed of a known wavelength shifting material, or contains such known wavelength shifting material dispersed therein or applied thereto as a coating. Such wavelength shifting material is operable to absorb the UV photons 156, with subsequent isotropic emission of lower wavelength photons 158 therefrom. In a preferred embodiment, the wavelength shifting material is operable to absorb the UV photons 156, with subsequent isotropic emission of photons 158 in the visible spectrum. In this way, a much improved fraction of the emitted photons 156 can be collected by the substrate 52 since such wavelength shifting material tends to absorb UV photons 156 at the cavity wall 66 rather than reflect it. Thus, in a preferred embodiment, dielectric substrate 52 is operable to absorb UV photons 156 emitted from the gaseous medium 84 during avalanche ionization that is incident upon sidewall 66, and convert such absorbed UV photons 156 to photons in the visible spectrum 158. Examples of such known wavelength shifting materials include diphenyl-stilbene, sodium salicyate, plastic scintillators. Such wavelength shifting material may be applied as a coating to the exposed surfaces of the substrate 52 in the form of, for example, a sodium salicyate or diphenyl-stilbene coating. Alternatively, the substrate 52 itself may be formed of a material, such as a plastic scintillator or fluorescent glass, which functions as a wavelength shifter.

In cases where the wavelength shifting material is applied as a coating to substrate 52, a protective coating may further be applied thereupon. Such a protective coating is useful to protect and preserve the wavelength shifting coating which may otherwise become damaged as a result of the charge amplification process. The protective coating may also provide a second advantage if it is formed of a material having a lower index of refraction than that of substrate 52. Such a material would thus not only protect the underlying wavelength shifting material, but could further enhance the light collection capability of substrate 52 by providing a so-called anti-reflective interface between gaseous medium 84 and substrate 52. It is to be understood that such an anti-reflective coating may be used regardless of whether a wavelength shifting coating is first applied, to thereby create such a low refractive index interface. An anti-reflective coating suitable for use with the present invention may be, for example, a known magnesium-based material operable to enhance the light collection capability of the underlying material.

Optical imaging device 150 further includes a photon detecting medium 152 coupled to the bottom surface 53 of substrate 52, which is operable to detect photons (as this term is defined herein) impinging thereupon, and to discriminate relative levels of radiation so detected. Preferably, the active area of medium 152 is matched to a single pixel input to a charge coupled device (CCD) camera, although the present invention contemplates that medium 152 may be any material or,device sensitive to photons and able to detect and discriminate between various intensity levels thereof. One example Of such an alternate medium may comprise an intermediate optical coupling, or optical conduit, which would permit reduction of the image prior to detection by, for example, a CCD camera. Such image reduction may effectively increase the area of coverage of the CCD camera by a factor of between approximately 10–100.

Within optical imaging device 150, photon detecting medium 152 is thus operable to detect any photons collected by substrate 52 that is able to find its way to the bottom surface 53 thereof. As shown in FIG. 2, such photons, preferably in the form of visible light 158, may be directed to bottom surface 53 of dielectric substrate 52 by internal imperfections therein, or by wavelength shifting material dispersed therein. However, a large portion of the visible light 158 will be directed toward cathode 72. For this reason, cathode 72 is preferably formed of a highly reflective (and electrically conductive) material to thereby direct photons (as the term is defined herein) impinging thereupon from within the substrate 52 back into the substrate 52. In this manner, much of the visible light 158 directed to the top surface 54 of dielectric substrate 52 is reflected off the underside of the cathode 72 toward the bottom surface 53 of dielectric substrate 52. Examples of such highly reflective materials for cathode 72 include titanium, titanium-tungsten alloys, gold, and the like.

Some of the photons 156 absorbed by dielectric substrate 52 (and subsequently emitted as visible light 158) will be directed to neither bottom surface 53 of substrate 52 nor top surface 54 of substrate 52, but will instead be directed parallel thereto. Such visible light 158 will therefore either be lost within substrate 52 or will create a source of error within a neighboring device if device 150 is part of a larger array or matrix of devices 150. Further improvements in light collection by,detecting medium 152 can be achieved by providing an arrangement for redirecting such "lateral" light back toward cavity 56. Two alternative embodiments of such a light redirecting arrangement are shown in FIG. 3 wherein several of the components shown in FIG. 2 are omitted for clarity.

Figure 3:
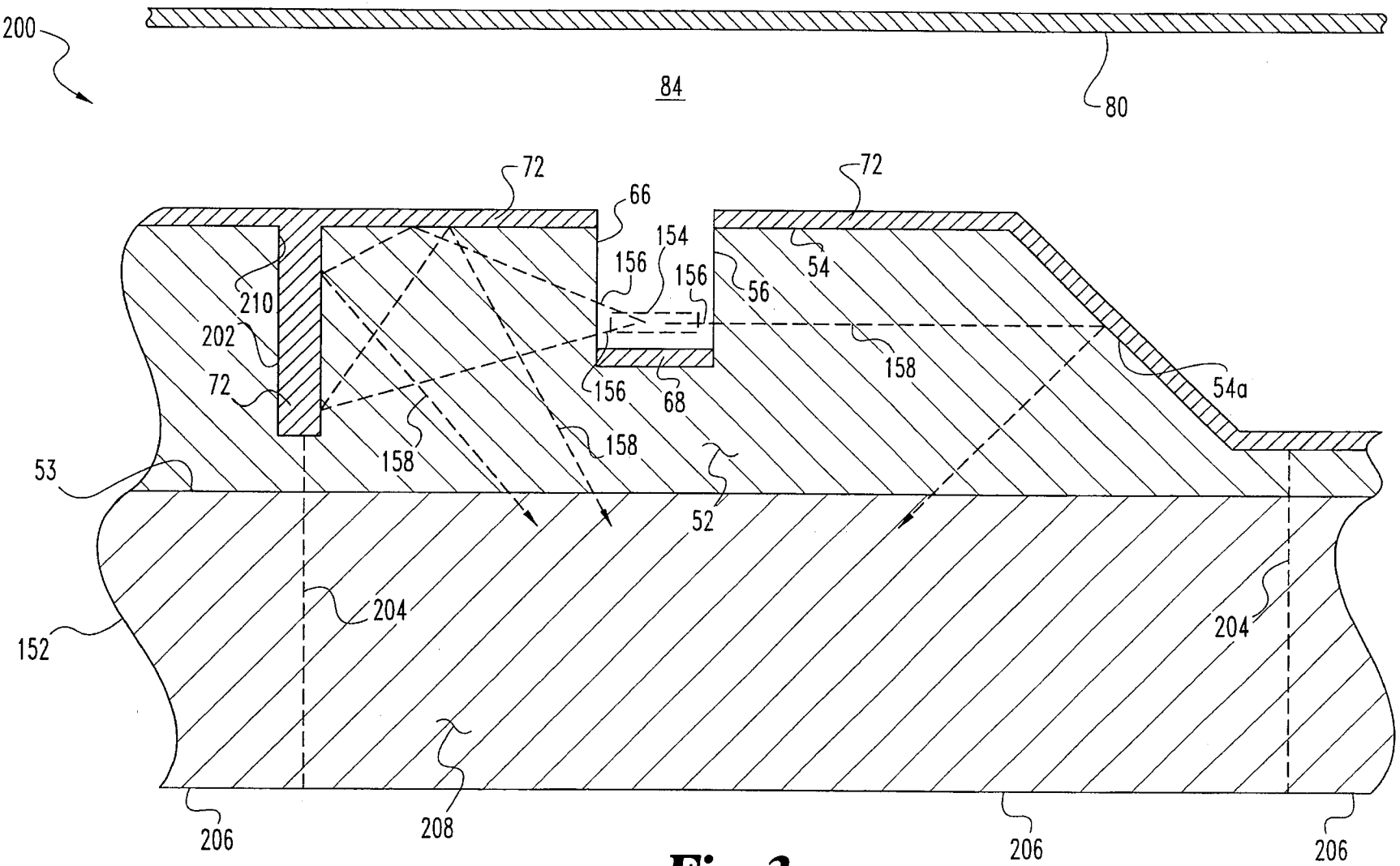
FIG. 3 is a cross-sectional illustration of the optical imaging device of FIG. 2 showing two alternative configurations for directing light from within the substrate toward the optical detector.

Referring now to FIG. 3, an optical imaging system 200 is shown which includes either an array or a matrix of optical imaging devices. In such a system, it is desirable to maintain photons 156 or 158 associated with cavity 56 within its corresponding "optical cell" 206, defined as the region within dashed lines 204. Typically, each optical cell 206 has associated therewith a photon detecting means 208 which corresponds to a single pixel of a photon detector such as, for example, a CCD camera. Photons 156 or 158 not so contained may lead to at least two sources of error. First, any cell 206 collecting photons 156 or 158 from a neighboring cell 206 may erroneously detect such photons 156 or 158 as being generated within,its own cavity 56. This first type of error results in decreased image resolution. Secondly, the cell losing such photons 156 or 158 will thus not be able to detect all of the photons 156 or 158 generated within its own cavity 56. This second type of error results in reduced sensitivity.

A first embodiment of a photon 156 or 158 redirecting arrangement is shown at the right side of FIG. 3 as a sloped surface 54*a* of the top surface 54 of dielectric substrate 52. If surface 54*a* of substrate 52 is sloped away from cavity 56 and toward the bottom surface 53 of substrate 52 as shown, then "lateral" photons 156 or 158 will be redirected by the bottom surface of cathode 72 toward the bottom surface 53 of substrate 52 within the appropriate optical cell 206.

A second embodiment of a photon 156 or 158 redirecting arrangement is shown at the left side of FIG. 3 and includes a second cavity 202 extending into the top surface 54 of substrate 52, preferably to a depth well below that of cavity 56. Preferably, cathode material 72 is disposed within cavity 202 to thereby provide a photon 156 or 158 reflecting surface. Cavity 202 need not have a substantially vertical sidewall 210 as shown, but may have a sidewall 210 that is instead sloped down and away from cavity 56. Such an angled sidewall 210 may, in fact, be preferable since such a structure more easily lends itself to simpler and less expensive etching techniques (if system 200 is fabricated in accordance with known semiconductor processing techniques). The present invention further contemplates that other materials may be disposed within cavity 202 that have a different index of refraction than that of substrate 52 to thereby reflect any incident photons 156 or 158 back into the optical cell 206 from which it originated. Finally, the present invention contemplates that other such materials may be diffused, implanted or otherwise provided within substrate 52 in place of cavity 102 to perform the photon redirecting function. It is to be understood that system 200 may include either one or both of the foregoing photon redirecting arrangements.

Those skilled in the art will recognize that although the radiation detector 50 of FIG. 1 may be a preferred device for use with the optical imaging device 150 or system 200 described herein, other known charge amplification devices may be provided within such a cavity structure 56 to thereby provide photons within cavity 56 during avalanche ionization as previously described. It is to be understood that the use of any such alternative charge amplification device is intended to fall within the scope of the present invention.

Figure 4:
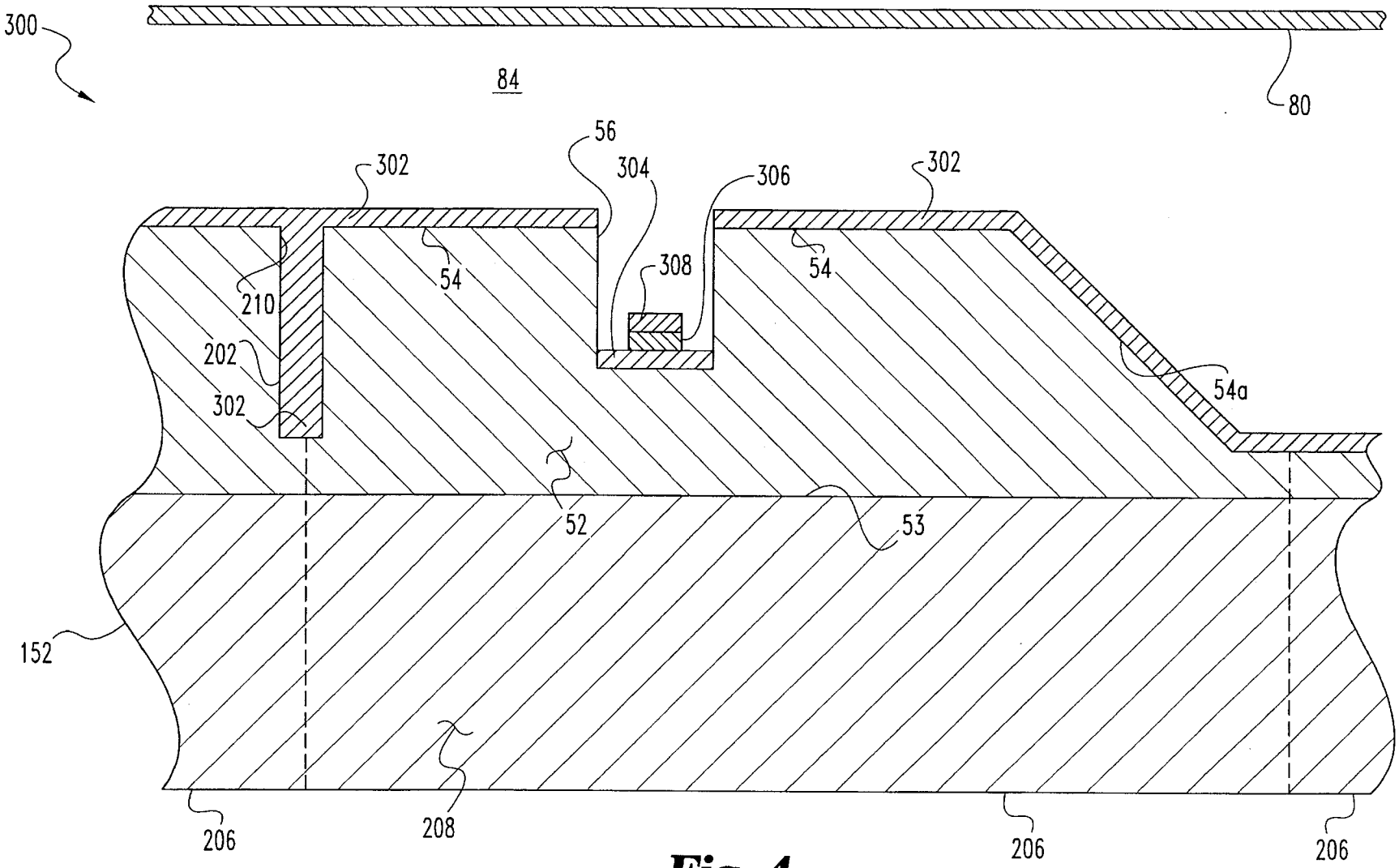
FIG. 4 is a cross-sectional illustration of one alternative charge amplification configuration for use with the optical imaging device of FIGS. 2–3.

One such alternative charge amplification device is shown in FIG. 4, which shows a so called MicroGap Chamber (MGC) configuration disposed within cavity 56 of the optical cell of FIG. 3 to thereby illustrate an alternative optical imaging system 300. Referring now to FIG. 4, cavity 56 includes an electrically conducting member 304 in the bottom thereof, upon which a dielectric layer 306 is positioned. A second electrically conducting member 308 is positioned atop dielectric layer 306. Typically, member 308 acts as the anode and member 306 acts as the cathode of the MGC charge amplifier, although the converse arrangement may be used as well. In operation, an intense electric field is established between members 304 and 308 to cause avalanche ionization of gaseous medium 84 therein. Photons emitted therefrom (not shown) may then be collected by substrate 52 and photon detector 208 as previously described. Moreover, one or both of the photon redirecting arrangements previously described and shown in FIG. 4 may be used to provide a more efficient photon collection system as previously described. In order to provide the photon reflective surface as previously described, a reflective layer 302 (comprising a cathode 72 in FIGS. 1–3) would be required within system 300.

Figure 5:
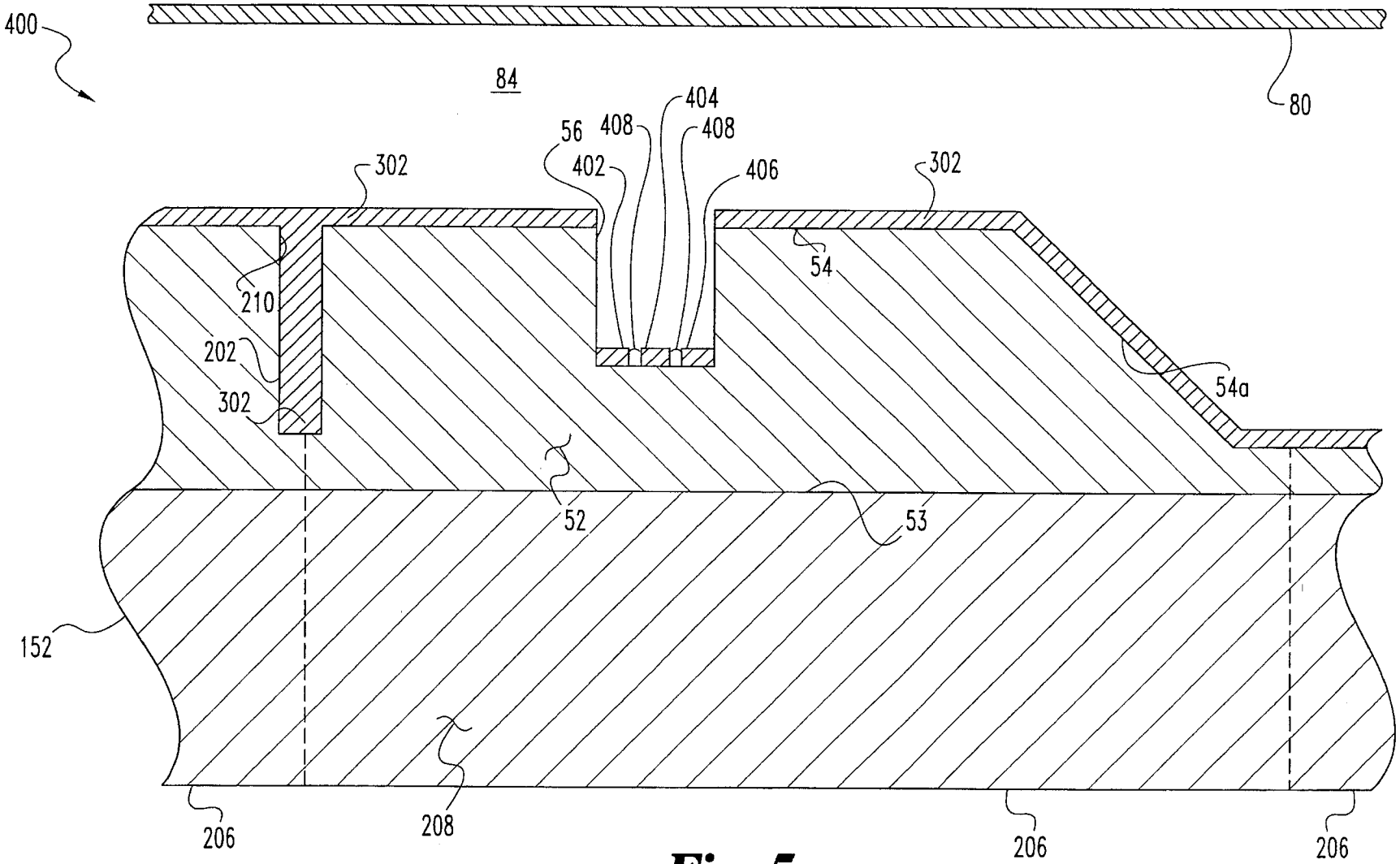
FIG. 5 is a cross-sectional illustration of another alternative charge amplification configuration for use with the optical imaging device of FIGS. 2–3.

Another such alternative charge amplification device is shown in FIG. 5, which shows a so called MicroStrip Gas Chamber (MSGC) configuration disposed within cavity 56 of the optical cell of FIG. 3 to thereby illustrate an alternative optical imaging system 400. Referring now to FIG. 5, cavity 56 includes electrically conducting members 402, 404 and 406 disposed in the bottom thereof which are each separated by gap 408. Members 402 and 406 may act as the cathode, while member 404 acts as the anode. In operation, an intense electric field is established between members 402 and 404, and between members 404 and 406, to cause avalanche ionization of gaseous medium 84 therein. Photons emitted therefrom (not shown) may then be collected by substrate 52 and photon detector 206 as previously described. Moreover, one or both of the photon redirecting arrangements previously described and shown in FIG. 4 may be used to provide a more efficient photon collection system as previously described. As with system 300, a reflective layer 302 (comprising a cathode 72 in FIGS. 1–3) is required to provide a photon reflective surface.

In either of the alternative embodiments shown in FIGS. 4 and 5, a fraction of quench gas would likely be required to be included within gaseous medium 84 to thereby decrease the photon feedback phenomenon, which limits the operability of the charge amplifier. Radiation detector 150 (FIG. 1), by contrast, drastically minimizes, and possibly eliminates, the photon feedback phenomenon so that such a quench gas is likely not required therein.

From the foregoing, it should be apparent that the present invention is operable to detect, and discriminate between various levels of, photons (as this term is broadly defined above) emitted as a result of an avalanche ionization event. Although the present invention has been described herein as preferably using a gaseous medium operable to emit UV photons during avalanche ionization, which is thereafter converted to visible light for detection by an optical imaging medium, it is to be understood that the present invention contemplates utilizing a gaseous medium operable to emit photons within the infrared, visible, X-ray and other spectra as well. In so doing, the dielectric substrate should either be constructed of, or contain, suitable material for converting such photons to visible light suitable for detection by the optical imaging medium. Alternatively, the present invention further contemplates utilizing a dielectrics substrate operable to collect photons emitted from the avalanche ionization event and provide such photons to the photon detecting medium without converting the photons to a different wavelength. In such a case, a suitable photon detecting medium would be necessary to detect the appropriate wavelength photons. The particular applications of the optical imaging device and system described herein include those appropriate to any radiation detector such as, for example, nuclear monitoring applications, neutron and x-ray imaging, and medical physics applications. In particular, such a system may form a high efficiency alternative to X-ray film in medical applications.

While the invention has been illustrated and described in detail in the drawings and foregoing description, the same is to be considered as illustrative and not restrictive in character, it being understood that only the preferred embodiments have been shown and described and that all changes and modifications that come within the spirit of the invention are desired to be protected. For example, the charge amplification device 55 described herein may also be used to operate a imaging system wherein the gaseous medium 84 is replaced with a liquid such as, for example, liquid argon or liquid xenon. In such an application, it may be desirable to render at least a portion of the dielectric substrate 52, near the cavity opening 62, conductive. This may be accomplished, for example, by disposing conductive particles within the appropriate areas of the substrate 52. Furthermore, in such an application, it may be desirable to coat the cathode 72 with a material having a higher work function than traditional cathode materials. This may also have the effect of permitting a reduction in the quantity of quench gas used in certain gaseous applications. It should be noted that the foregoing modifications of rendering at least a portion of the dielectric substrate 52 conductive and coating the cathode 72 with a material having a high work function may also be made to a radiation detector having a gaseous medium 84 to thereby optimize the operation thereof.

As a second example, it has been noted herein that the present invention contemplates techniques other than micromachining and other known semiconductor fabrication techniques for constructing a charge amplifier 55 of the type forming a part of the present invention. One such technique may involve either laser cutting or micro-machining device 55 from a metal clad insulator, such as copper clad Kapton® dielectric film. Essentially, the Kapton® dielectric film is sandwiched between copper affixed thereto so that a cavity may be formed from the top surface thereof to the lower layer of copper.

Another technique for constructing a charge amplifier 55 involves providing a capillary tube and a wire having the same inner diameter. The tube is cut so that the cut surface is perpendicular to the axis of the inner hole, after which the cut surface is provided with a conductive surface such as by plating, spraying or painting. The conductive surface of the cut tube acts as the cathode. The wire, acting as the anode, is inserted into the inner hole from the opposite end of the tube where the cut was made, and advanced to a desired depth below the cut surface.

Yet another technique for constructing a charge amplifier 55 involves using a capillary tube as previously described, but advancing a metalized member therein to form the anode. If, for example, MYLAR® polyester film coated with Indium Tin Oxide is used as the anode material, light from the avalanche can effectively be extracted from the cavity since this coating is approximately 80% light transmissive.

Still another technique for constructing a charge amplifier 55 involves boring a cavity into a metalized member, such as aluminized MYLAR® polyester film, to a desired cavity depth.

What is claimed is:

1. An imaging device for providing a radiative representation of charges comprising:

a substrate having a top surface and an opposite bottom surface, said top surface defining a cavity having a cavity sidewall extending into said substrate;

a gaseous medium disposed within said cavity, said gaseous medium including charges resulting from ionization thereof; and means for establishing avalanche ionization of charges with said gaseous medium within said cavity to thereby provide amplified emission of photons from said gaseous medium;

wherein said cavity sidewall is operable to absorb emitted photons incident thereupon, and said substrate is operable to direct the absorbed photons impinging upon said top surface thereof from within said substrate toward said bottom surface of said substrate.

2. The imaging device of claim 1 further including means in contact with said top surface of said substrate for directing photons impinging thereupon from within said substrate back into said substrate.

3. The imaging device of claim 2 further including means coupled to said bottom surface of said substrate for detecting photons impinging thereupon.

4. The imaging device of claim 3 wherein said emission of photons from said gaseous medium includes any combination of ultraviolet (UV) radiation, infrared (IR) radiation and visible light.

5. The imaging device of claim 4 wherein said substrate includes a wavelength shifting material operable to convert UV radiation to visible light.

6. The imaging device of claim 5 further including a protective coating in contact with said substrate, said protective coating having a lower index of refraction than that of said substrate.

7. The imaging device of claim 6 wherein said wavelength shifting material is disposed in contact with said substrate, and said protective coating is disposed in contact with said wavelength shifting material such that said wavelength shifting material is sandwiched between said substrate and said protective coating.

8. The imaging device of claim 5 wherein said substrate is a dielectric material.

9. The imaging device of claim 3 wherein said top surface of said substrate remote from said cavity slopes downwardly away from said cavity and toward said bottom surface of said substrate;

and wherein said means in contact with said top surface of said substrate is operable on said sloped top surface to direct photons impinging thereupon from said substrate back into said substrate toward an area of said bottom surface of said substrate adjacent said cavity.

10. The imaging device of claim 3 further including means extending into said substrate from said top surface remote from said cavity for directing photons impinging thereupon from within said substrate back into said substrate.

11. The imaging device of claim 10 wherein said means extending into said substrate includes a well extending into said substrate, said well containing said means in contact with said top surface of said substrate therein.

12. An imaging device for providing a radiative representation of charges comprising:

a dielectric substrate having a bottom surface and an opposite top surface defining a cavity therein, said cavity having a cavity sidewall extending into said substrate and terminating in an electrically conductive anode surface;

an electrically conductive cathode formed on said dielectric substrate top surface and terminating adjacent said cavity opening, said cathode being operable to direct photons impinging thereupon from within said dielectric substrate toward said bottom surface of said dielectric substrate;

a gaseous medium in contact with said cathode and extending into said cavity into contact with said anode surface, said gaseous medium including charges resulting from ionization thereof;

wherein said anode surface and said cathode define a first electric field therebetween sufficient to cause avalanche field therebetween sufficient to cause avalanche ionization of the charges with said gaseous medium adjacent said anode surface to thereby provide amplified emission of photons from said gaseous medium, and wherein said cavity sidewall is operable to absorb emitted photons incident thereupon.

13. The imaging device of claim 12 further including means coupled to said bottom surface of said substrate for detecting photons impinging thereupon.

14. The imaging device of claim 13 wherein said emission of photons from said gaseous medium includes any combination of ultraviolet (UV) radiation, infrared (IR) radiation and visible light.

15. The imaging device of claim 14 wherein said substrate includes a wavelength shifting material operable to convert UV radiation to visible light.

16. The imaging device of claim 15 further including a protective coating in contact with said substrate, said protective coating having a lower index of refraction than that of said substrate.

17. The imaging device of claim 16 wherein said wavelength shifting material is disposed in contact with said substrate, and said protective coating is disposed in contact with said wavelength shifting material such that said wavelength shifting material is sandwiched between said substrate and said protective coating.

18. The imaging device of claim 15 further including a drift electrode juxtaposed with said dielectric substrate opposite said cathode and defining a gas region therebetween containing said gaseous medium.

19. The imaging device of claim 18 further including a source of radiation operable to emit radiation through said drift electrode and ionize molecules within said gaseous medium to thereby provide the charge pairs resulting from ionization of the gaseous medium.

20. The imaging device of claim 19 wherein said anode surface and said drift electrode define a second electric field therebetween sufficient to cause said charge pairs to separate such that positive charges drift toward said drift electrode and electrons drift toward said anode surface.

21. The imaging device of claim 19 wherein said source of radiation is an X-ray source;

and wherein said means coupled to said bottom surface of said dielectric substrate for detecting photons impinging thereupon is an optical detector.

22. The imaging device of claim 13 wherein said top surface of said substrate remote from said cavity slopes downwardly away from said cavity and toward said bottom surface of said substrate;

and wherein said cathode is operable on said sloped top surface to direct photons impinging thereupon from said substrate back into said substrate toward an area of said bottom surface of said substrate adjacent said cavity.

23. The imaging device of claim 13 wherein said cathode extends into said substrate from said top surface remote from said cavity for directing photons impinging thereupon from within said substrate back into said substrate.

24. The imaging device of claim 12 wherein said cathode has a bottom surface forming an interface with said top surface of said dielectric substrate, an opposite top surface and a thickness therebetween terminating in a cathode sidewall surface coterminous with said cavity opening.

25. The imaging device of claim 12 wherein said gaseous medium includes a noble gas.

26. The imaging device of claim 12 further including a plurality of imaging devices arranged as a matrix of imaging devices.

* * * * *

UNITED STATES PATENT AND TRADEMARK OFFICE

CERTIFICATE OF CORRECTION

PATENT NO. : 5,602,397

DATED : February 11, 1997

INVENTOR(S) : William K. Pitts et al.

It is certified that error appears in the above-indentified patent and that said Letters Patent is hereby corrected as shown below:

In col. 2, line 37, please change "he" to --the--.

In col. 4, line 50, please insert --of-- before "such".

In col. 5, line 15, please delete "and", second occurrence.

In col. 5, line 24, please delete the second comma.

In col. 5, line 51, please change "abroad" to --a broad--.

In col. 6, line 23, please change "Cathode" to --cathode--.

In col. 6, line 44, please change ";" to --,--.

In col. 6, line 66, please change "radiations" to --radiation--.

In col. 7, line 8, after "field" please insert a period.

In col. 8, line 16, please delete the comma.

In col. 8, line 18, please change "Of" to --of--.

UNITED STATES PATENT AND TRADEMARK OFFICE

CERTIFICATE OF CORRECTION

PATENT NO. : 5,602,397

DATED : February 11, 1997

INVENTOR(S) : William K. Pitts et al.

It is certified that error appears in the above-indentified patent and that said Letters Patent is hereby corrected as shown below:

In col. 8, line 51, please delete the comma.

In col. 9, line 2, please delete the comma.

In col. 10, line 48, please change "dielectrics" to --dielectric''.

In col. 12, line 67, please delete "field therebetween sufficient to cause avalanche".

Signed and Sealed this

Second Day of September, 1997

Bruce Lehman

*Attest:*

BRUCE LEHMAN

*Attesting Officer*

*Commissioner of Patents and Trademarks*

UNITED STATES PATENT AND TRADEMARK OFFICE

CERTIFICATE OF CORRECTION

PATENT NO. : 5,602,397

DATED : February 11, 1997

INVENTOR(S) : Pitts et al.

It is certified that error appears in the above-indentified patent and that said Letters Patent is hereby corrected as shown below:

On the title page under "Assignee", item [73] should read:

-- University of Louisville Research Foundation, Inc., Louisville, KY, and Indiana University Foundation, Indianapolis, IN.--

Signed and Sealed this

Tenth Day of August, 1999

*Attest:*

Q. TODD DICKINSON

*Attesting Officer*

*Acting Commissioner of Patents and Trademarks*